United States Patent [19]

Takada

[11] 4,094,046

[45] June 13, 1978

[54] SEAT BELT BUCKLE

[75] Inventor: Juichiro Takada, Tokyo, Japan

[73] Assignee: Takata Kojyo Co., Ltd., Tokyo, Japan

[21] Appl. No.: 714,543

[22] Filed: Aug. 16, 1976

[30] Foreign Application Priority Data

Aug. 19, 1975 Japan ..... 50-113475

[51] Int. Cl.[2] ..... A44B 11/25

[52] U.S. Cl. ..... 24/230 AK; 24/230 A

[58] Field of Search ..... 24/230 AK

[56] References Cited

U.S. PATENT DOCUMENTS

| | | | |
|---|---|---|---|
| 3,156,025 | 11/1964 | Carter | 24/230 AK |
| 3,399,431 | 9/1968 | Shanklin | 24/230 AK |
| 3,505,711 | 4/1970 | Carter | 24/230 AK |
| 3,517,416 | 6/1970 | Frei | 24/230 AK |
| 3,600,768 | 8/1971 | Romanzi | 24/230 AK |
| 3,722,909 | 3/1973 | Esner | 24/230 AK |
| 3,908,243 | 9/1975 | Lou | 24/230 AK |

FOREIGN PATENT DOCUMENTS

| | | | |
|---|---|---|---|
| 1,316,414 | 12/1962 | France | 24/230 AK |
| 1,340,076 | 9/1963 | France | 24/230 AK |
| 657,156 | 10/1963 | Italy | 24/230 AK |
| 892,209 | 3/1962 | United Kingdom | 24/230 AK |

*Primary Examiner*—Bernard A. Gelak

*Attorney, Agent, or Firm*—Wolder, Gross & Yavner

[57] ABSTRACT

A safety belt coupling device includes a buckle having a hollow body provided with a front tongue receiving opening and an upwardly projecting latch member having an inclined front face. A coupling tongue having a front latch opening is slideable through the tongue receiving opening over the latch member to bring the latch opening into engagement with the latch member. A transverse lock bar is longitudinally movable between a lock position overlying the free end of the latched tongue to prevent the raising thereof and an unlock position rearward of the tongue free end to permit unlatching of the tongue and is biased to its unlock position. The lock bar lies in the path of the raised tongue free end and a finger actuated release member upon depression retracts the bar to its unlock position, and in one form includes a member rockable about a transverse axis and having cam slots engaging the lock bar, and in another form includes a longitudinally slideable push member lost motion coupled to the lock bar.

2 Claims, 7 Drawing Figures

SEAT BELT BUCKLE

BACKGROUND OF THE INVENTION

The present invention relates generally to improvements in vehicle safety belt devices and it relates more particularly to an improved vehicle safety belt buckle or coupling device.

Safety or restraint belts have been extensively employed for the occupants of the seats of automobiles and other transport facilities to minimize any injury to the passengers attendant to accidents. Conventional buckles for seat belts of this kind are largely of the type in which a handle provided on the buckle body is elevated to release from the buckle the coupling tongue piece fastened to the end of the belt. However, buckles of this type were complex in construction and posed many problems unsolved from the viewpoint of workability and calling for improvement.

In view of such circumstances, extensive research has been conducted by the present inventor in an attempt to improve buckles of various types, and he has previously proposed a buckle for seat belts having high safety performance, by which a certain portion of the buckle is depressed by a finger to release the engagement between the buckle and the tongue piece, replacing the elevating motion of a handle of the conventional devices.

While the resulting buckle structure had some advantages, it possessed numerous disadvantages. It was a somewhat bulky, awkward and complicated device, difficult and expensive to fabricate and assemble, and otherwise left much to be desired.

It is accordingly a principal object of the present invention to provide an improved vehicle safety belt device.

Another object of the present invention is to provide an improved vehicle safety belt coupling device.

Still another object of the present invention is to provide an improved vehicle safety belt buckle.

A further object of the present invention is to provide an improved device of the above nature characterized by its high reliability, ruggedness, simplicity, compactness, ease and convenience of use, low cost of manufacture and assembly, and great versatility and adaptability.

The above and other objects of the present invention will become apparent from a reading of the following description taken in conjunction with the accompanying drawings which illustrate preferred embodiments thereof.

In a sense, the present invention comtemplates the provision of an improved safety belt buckle for use with a coupling tongue having a latch opening in which the buckle includes a body having a base wall and longitudinally spaced side walls having parallel longitudinal slots, the base wall being provided with an upwardly directed latch member which releasably engages the coupling tongue latch opening, the tongue leading end being insertable into the body member to bring the latch opening into vertical registry with the latch member and being vertically movable to bring the latch opening and member into releasable engagement. A transversely extending lock bar or pin extends between and has its ends slideably engaged by the side wall slots and lies in the longitudinal path of the raised leading end of the inserted coupling tongue and is longitudinally movable between positions rearward of and overlying the leading end of the tongue to define unlock and lock positions respectively, and is spring biased to its lock position. A finger operated release member is selectively actuatable to move the lock bar to its unlock position and may be in the form of a slide member coupled to the lock bar by a lost motion coupling or a swingably supported member having cam surfaces engaging the lock bar. The release member is spring biased to a retracted position.

The improved buckle is simple, inexpensive, rugged, reliable, easy and convenient to operate, highly compact, simple to manufacture and of great versatility and adaptability.

DESCRIPTION OF THE PREFERRED EMBODIMENTS

Figure 1:
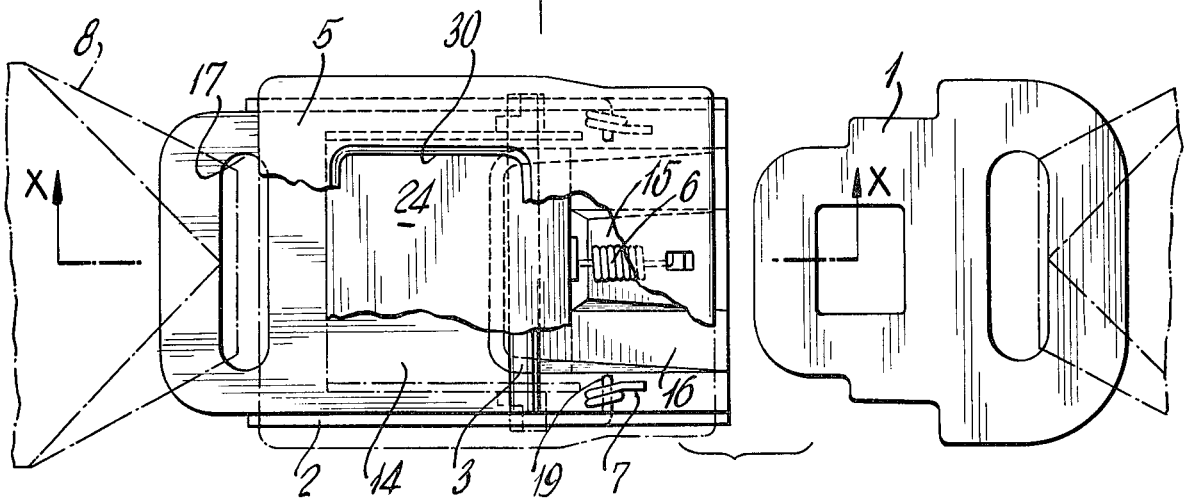
FIG. 1 is a top plan view, partially fragmented, of a preferred embodiment of the present invention shown in uncoupled condition.
Figure 2:
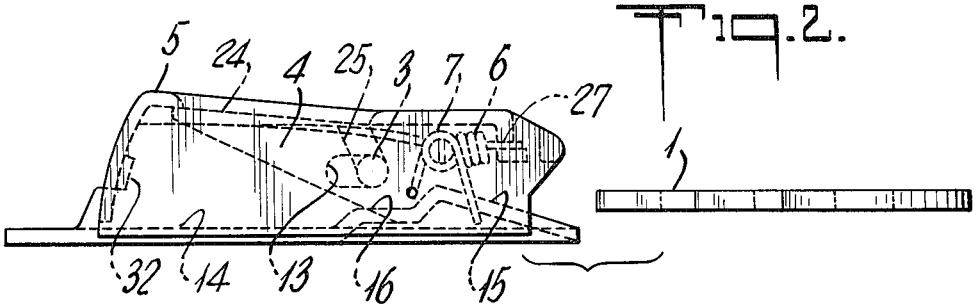
FIG. 2 is a side elevational view thereof.

Referring now to the drawings, particularly FIGS. 1 to 5 thereof which illustrate a preferred embodiment of the present invention, the reference numeral 1 generally designates a coupling tongue piece and 2 the frame or body of the buckle that accepts the leading end of the tongue piece 2 through a front opening in the frame for coupling and uncoupling the tongue piece to the buckle. The tongue piece has formed proximate its leading or free end a latch opening the leading border of which is defined by a latch or cross bar and the trailing end of the tongue piece is provided with a belt securing slot. The frame 2 includes a base plate 14 and opposing side plates that are directed upwardly from both longitudinal sides of the base plate 14. The front end portion of base plate 14 is partly raised and has a latch member defining and engaging projection 15 which is medially located to releasably engage and latch the latch opening in the tongue piece 1 and which is located on a raised base surface 16 which determines the angle at which the tongue piece is inserted. The projection 15 has a sharply upwardly forwardly inclined rear face and a slightly downwardly forwardly inclined upper front face. A long hole or slot 13 which is nearly parallel to the base surface 16 of the frame 2 is provided in each of the side plates 12 near the tip position of the leading end of the tongue piece 1 in its buckle inserted position beyond the engaging protrusion 15, and with said slots 13 is slideably engaged a transverse lock bar or elevation preventing pin 3 that prevents the elevating motion of the tongue piece 1. The side plates 12 of the frame have, as shown in the drawings, aligned pivot holes 18 which pivotally engage the rockable ears or plates 26 of the release or pressing member 4, spring hooking holes 20, and a recess 21 engaging the tips of a buckle cover. The side plates 12 also have at their front part notches 23 to increase the insertion angle of the tongue piece 1, define the insertion depth of the tongue piece 1 and prevent the upward movement of the tongue pice 1, as well as at their rear part notches 22 which engage the rear part of the buckle cover 5. On both sides of the base surface 16 are formed inwardly projecting fingers 19 and hairpin springs 7 which function to eject the tongue piece 1 are mounted as shown in FIGS. 1 and 2. The reference numeral 17 is a slot for connecting the buckle to the seat belt.

The operation or release member 4 is swingably mounted to the frame 2 and plays an important role for the engagement and disengagement of the tongue piece. The upper surface of the operation member 4 serves as a pressing surface 24, and opposite side walls depend therefrom and have inclined cam holes or slots 25 which intersect and cooperate with the long holes 13 in the side plates 12 of the frame 2. At the lower external faces of member 4 are provided the pivot plate 26 which project outwardly to superpose the side walls depending from top wall 24 of the operation member 4 on the inside faces of the side plates 12 of the frame 2 in a manner that the elevation preventing pin 3 is inserted through and in sliding engagement with the long holes 13 and the camholes 25. The pivot plates 26 are then fitted to the holes 18 to couple the operation member 4 to the frame 2. The reference numeral 27 is a pin provided and mounted on the inner surface at the front curved part of the operation member 4. To the pin 27 is hooked one end of the spring 6. The other end of the spring 6 is hooked to the front part of the buckle cover 5 as hereinafter described.

The buckle cover 5 is so formed as to contain the operation member 4 above the aforesaid frame 2, and has a window 30 through which is exposed the pressing surface or plate 24 of operation member 4 and further has recesses 31 that register with recesses 21 in frame 2 and a protrusion 32 that engages the notches 22. The reference numeral 33 designates an opening formed at the tip of the buckle covering 5.

Figure 4:
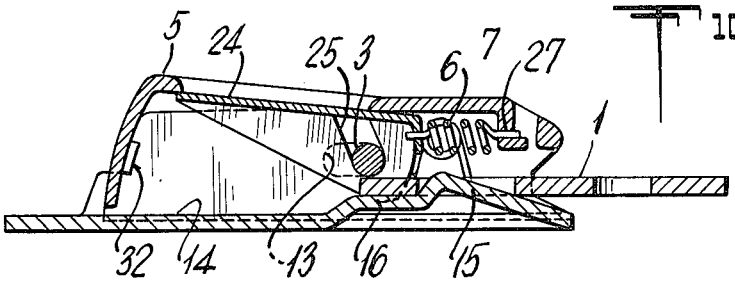
FIG. 4 is a medial longitudinal vertical cross sectional view thereof shown in a coupled condition.

The operation member 4 is fitted to the frame 2 and the elevation preventing pin 3 is inserted through the long holes 13 and the cam holes 25 so as to fasten the pivot plates 26 to the pivot holes 18. The springs 7 are then mounted on the projections 19 as a shaft, and then the tension spring 6 is connected between the operation member 4 and the buckle cover 5 in order that the elevation preventing pin 3 is resiliently urged or biased to the front of the long holes 13 as seen in FIGS. 2 and 4. The protrusion 32 of the buckle cover 5 is then fitted to the notch of the frame 2 to complete assembly of the buckle of the present invention.

Figure 5:
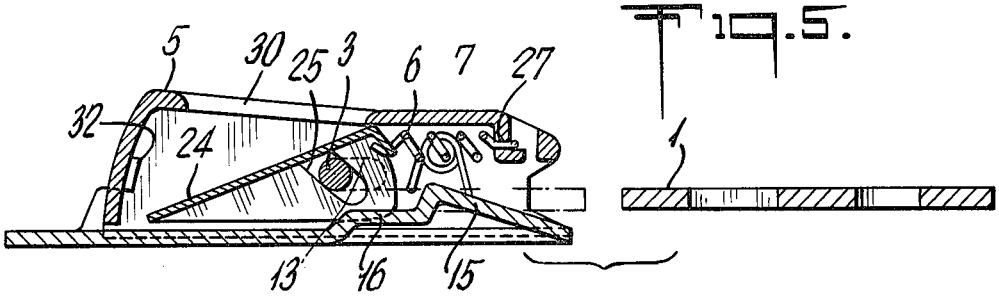
FIG. 5 is a view similar to FIG. 4 but shown in uncoupled released condition.

To insert or remove the tongue piece 1 with respect to the buckle, the tongue piece 1 shown in FIG. 2 is brought near to the buckle front or insertion hole, and is then pushed beyond the engaging projection 15 to easily perform the fastening. At this time the motion at the tip of the tongue piece 1 is interrupted by the elevation preventing pin 3 which is positioned in front of the long hole 13 and the elevating motion of the tongue piece is thus prevented. Then to release the tongue piece, the pressing surface 24 is downwardly pressed, whereby the lock bar or elevation preventing pin 3 is moved along the cam hole 25 of the operation member 4, as shown in FIG. 5, and the pin 3 is moved from the front side toward the rear side in the long hole 13. The restraining action to the tongue piece 1 is released and the tongue piece 1 is easily released by the force of the spring 7.

Figure 6:
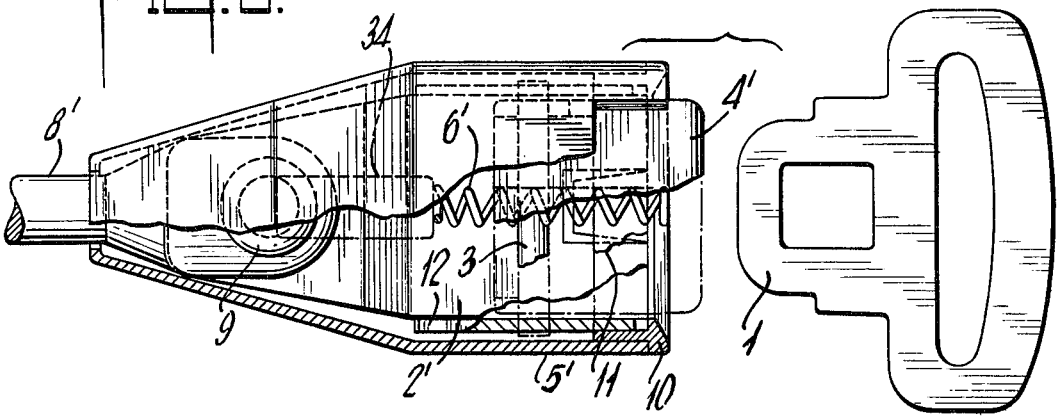
FIG. 6 is a top plan view, partially fragmented, of another embodiment of the present invention shown in uncoupled condition.
Figure 7:
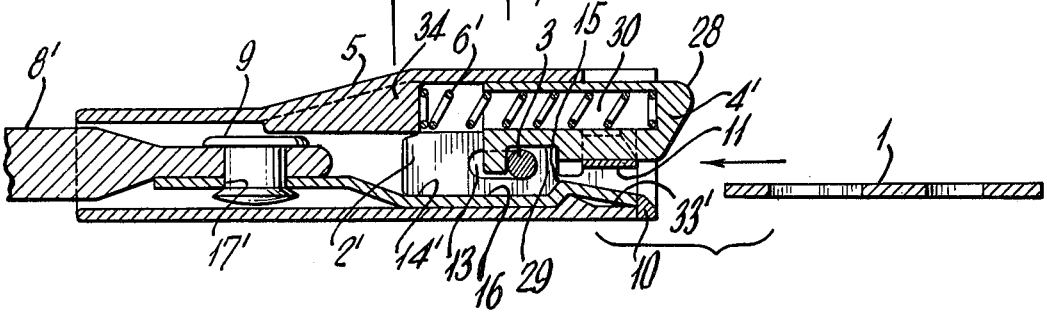
FIG. 7 is a medial longitudinal vertical cross sectional view thereof.
Figure 3:
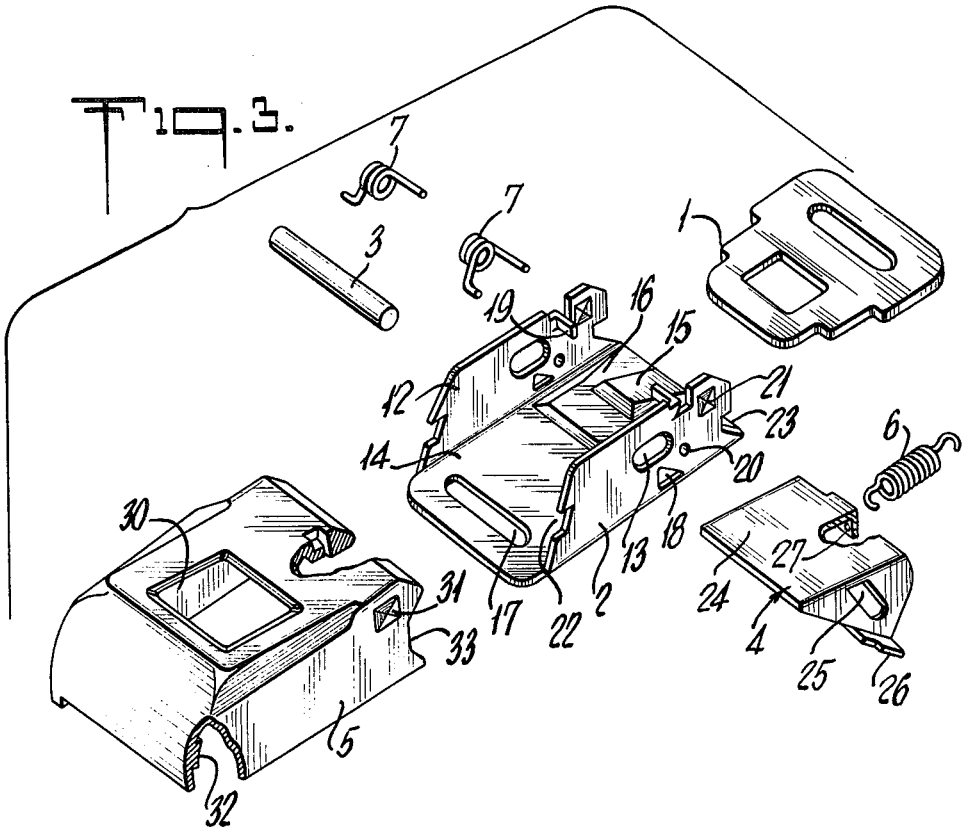
FIG. 3 is an exploded perspective view thereof.

FIGS. 6 and 7 show another embodiment of the buckle of the present invention and except as described is similar to the one shown in FIGS. 1 to 5. Although the pressing mechanism of the first embodiment included an upper pressing surface or plate at its upper part so that the tongue piece 1 was liberated and disengaged when it was depressed, the mechanism in this embodiment is equipped with a release or slide pressure member 4' that moves horizontally in the back and forth directions. The slide pressure member 4' has on both of its walls an operation recess 29 that is provided with depending shoulders or fingers at its front and rear, in place of the cam holes. Both ends of the elevation preventing pin 3 slideably engage the long holes 13, are positioned in the recesses 29 so as to be lost motion coupled with the slide member 4'. Further, at the upper central part is provided a spring bore 30 containing a pressure-type coil spring 6', the spring 6' being entrapped between the slide pressure member 4' and a spring abutment 34 of buckle cover 5'.

In the embodiment shown, the buckle cover 5' is of the type to be inserted from the rear of the buckle, in which the base plate 14' is extended toward the rear and its rear end is fastened.

In the above manner, the tongue piece 1 fastened to one side of the seat belt can be easily coupled or uncoupled with the buckle which is fastened to the other side of the seat belt with a flexible member 8' made of wire contained in the seat belt by way of rivet 9 at the connection hole 17', and connected to the fixed point of the belt.

Such a connection may, of course, be done by stitching the belt, or by fastening it directly to the seat as shown in FIGS. 1 to 5, or a belt length adjusting means may be provided as required.

Also, where the buckle cover 5' is made in the shape as shown and set up as mentioned above, the opening 33' on the side of insertion of the tongue piece 1 forms an insertion hole and provides a slide surface for the slide pressure member 4', whereby the guide plate 11 is engaged to the long hole or notch formed on the side plates of the frame 2, simultaneously interrupting the the elevating movement of the tongue piece 1.

When the tongue piece 1 is to be inserted in the buckle shown in FIGS. 6 and 7, the wall of the latch hole of the tongue piece 1 is introduced beyond the engaging protrusion 15 and engaged in the same manner as in the case of FIGS. 1 to 5, and at this moment, the engagement takes place with the tip of the tongue piece 1 being restricted by the elevation preventing pin 3. To release the tongue piece 1, the slide pressure member 4' is manually pressed so as to be moved in parallel and rearwards. The elevation preventing pin 3 positioned in the recess 29 is then pressed to the wall of the recess 29 and moved rearward releasing the tip of the tongue piece 1 from the restriction, whereby the tongue piece 1 is liberated from the buckle.

Other mechanisms, operations and functions are the same as those of the first embodiment as illustrated in FIGS. 1 to 5.

In this way, the buckle body of the present invention can be fastened to the seat belt to enable easy buckling and unbuckling operations of the belt.

The buckle of the present device comprises the pressure operation member as mentioned above. And by simple operating the operation member, the elevation preventing pin is moved to liberate the tip of the tongue piece from the restriction, enabling it to disengage the tongue piece, i.e., to unbuckle the belt. Therefore, as compared to the earlier buckles of this kind, the number of required parts is reduced contributing to an increase in productivity and economy. Further, the buckle provides both features of push type and slide type using almost common parts, and is very economical having simple construction. Still more, since the elevation preventing pin is reliably moved, the fastening performance is also reliable and is very suited as a buckle for seat belts where safety is required.

Moreover, the buckle of the present device is simple in mechanism and small in size, and is suited to be mounted in the restricted space of an automobile to fasten the seat belts, permitting easy insertion of the tongue-piece and release of the tongue piece simple by depressing the pressing member, which are very simple and practical operations.

While there have been described and illustrated preferred embodiments of the present invention, it is apparent that numerous alterations, omissions and additions may be made without departing from the spirit thereof.

I claim:

1. A seat belt buckle in which a tongue piece (1) is engaged or disengaged with the buckle characterized in that a frame (2) consisting of a base plate (14) and opposed side plate (12) that are directed upwardly from both sides of said base plate (14) has an engaging protrusion (15) and a base surface (16) that will accept said tongue piece (1); slots 13 that are nearly parallel with said base surface (16) are provided in both side plates (12) at near a tip position of said tongue piece (1) that is inserted beyond said engaging protrusion (15), and an elevation preventing pin (3) which prevents the elevating motion of the tongue piece (1) slideably engages and extends between said slots (13), an operation slide member (4') having a recess (29) of a length greater than the width of and engaging said elevation preventing pin, a transversely extending guide plate (11) which is fastened between the two side plates (12) of the frame (2); above the protrusion (15) restricting said slide member to a longitudinal movement; a buckle cover (5) having an exposure hole to expose said operation slide member is mounted on said frame 2, and a spring (6) is provided between said buckle cover (5) and said operation slide member in a manner that said elevation preventing pin (3) is resiliently biased to a forward position; and said operation member is operated to move the elevation preventing pin (3) in the backward direction in order that the tongue piece (1) is disenaged.

2. A safety belt coupling device comprising a hollow casing having a front opening a body member housed in said casing and including a bottom wall and longitudinally extending side walls having opposite substantially linear, parallel longitudinal guide slots substantially parallel to said bottom wall, a latch member projecting upwardly from said bottom wall rearwardly of and proximate to said front opening and including a rearwardly directed rear face and a forwardly downwardly inclined front face, a cross piece extending transversely above said latch member and defining a guide throat therewith, a tongue member slidable through said front opening and guide throat and having a latch opening proximate its leading end releasably engagable by said latch member, the leading end of said tongue member in said front opening inserted position being vertically movable between a latch position with said latch member and latch opening being in mutual engagement to restrict the relative longitudinal movement of said tongue and said latch member, and an unlatch position with said leading end of said tongue member being vertically offset relative to said latch member to permit the retraction of said tongue member, a transversely extending lock bar having opposite ends slidably engaging said guide slots and being longitudinally movable in said body member along a path restricted to a direction parallel to said bottom wall between a lock position directly overlying the leading portion of said inserted latch tongue to prevent the unlatching thereof and an unlock position rearward of the latch tongue leading end to permit the unlatching of said tongue, said lock bar being exposed to and in the longitudinal path of the raised leading end of said tongue during the insertion movement thereof, and selectively operable release means for retracting said lock bar to its unlock position including a slide member accessible through said casing and disposed above said cross piece and longitudinally movable between a forward retracted position and an advance release position and abutments depending from said slide member on opposite sides of said lock bar and longitudinally spaced a distance greater than the width of said lock bar to alternatively engage said lock bar with the forward and rearward movement thereof to provide a lost motion coupling between said lock bar and slide member and spring means biasing said slide member to its retracted position whereby said lock bar is biased toward its lock position.

* * * * *